United States Patent [19]

Hildebrandt et al.

[11] 4,203,517

[45] May 20, 1980

[54] CONTAINER

[75] Inventors: Bodo Hildebrandt, Riedstadt; Erich Janele, Hünfeld-Nüst; Franz Steigerwald, Griesheim, all of Fed. Rep. of Germany

[73] Assignee: Wella Aktiengesellschaft, Darmstadt, Fed. Rep. of Germany

[21] Appl. No.: 965,915

[22] Filed: Dec. 4, 1978

[30] Foreign Application Priority Data

Dec. 2, 1977 [DE] Fed. Rep. of Germany ..... 2753737

[51] Int. Cl.[2] ..... B65D 25/08; B65D 1/04; B65D 81/32

[52] U.S. Cl. ..... 206/221; 215/DIG. 8; 220/23

[58] Field of Search ..... 206/219, 221, 220; 215/DIG. 8; 220/23

[56] References Cited

U.S. PATENT DOCUMENTS

| | | | |
|---|---|---|---|
| 2,793,776 | 5/1957 | Lipari | 215/DIG. 8 |
| 3,410,444 | 11/1968 | Morane | 206/221 |
| 3,439,823 | 4/1969 | Morane | 206/221 |
| 3,489,306 | 1/1970 | Bubb | 206/221 |
| 3,924,741 | 12/1975 | Kachur et al. | 215/DIG. 8 |
| 4,024,952 | 5/1977 | Leitz | 215/DIG. 8 |
| 4,132,308 | 1/1978 | Goncalves | 206/219 |

FOREIGN PATENT DOCUMENTS

| | | | |
|---|---|---|---|
| 2,362,963 | 7/1974 | Fed. Rep. of Germany | 206/219 |

*Primary Examiner*—William T. Dixson, Jr.
*Attorney, Agent, or Firm*—Michael J. Striker

[57] ABSTRACT

A container for separately accommodating two materials and mixing the same, has a first and second wall bounding a wider and narrower chamber, a connecting sleeve having one portion which is sealingly fitted on the first wall and another portion extending in an opposite direction and having an outer thread, a discharge cap connected to the second wall and having an inner thread which meshes with the outer thread of the other portion of the connecting sleeve so that the discharge cap is movable relative to the connecting sleeve, and a separating member having a separating portion which disconnects the chambers from one another and a projecting portion which extends into the narrower chamber and is held by the second wall. The second wall has an outer projection engaging in an inner groove in the other portion of the connecting sleeve so as to retain the discharge cap on the other portion of the connecting sleeve during unscrewing of the former. The groove has a length which is substantially equal to the length of the projecting portion of the separating member.

29 Claims, 5 Drawing Figures

CONTAINER

BACKGROUND OF THE INVENTION

The present invention relates to a container, and more particularly to such a container in which two materials can be accommodated in separate chambers and then can be mixed with one another in a wider chamber, if necessary.

A great variety of containers of the above-mentioned general type are known in the art. Two of them are disclosed, for instance, in the U.S. Pat. No. 3,326,400 and the German Offenlegungschrift 2,707,464. These containers are sometimes not satisfactory in the sense of simplicity of manufacture, reliability of separation of the materials from one another, and provision of simple and at the same time reliable mixing of the materials and discharging of the latter.

SUMMARY OF THE INVENTION

Accordingly, it is an object of the present invention to provide a container for accommodating two materials separately from one another and mixing the same with one another, which avoids the disadvantages of the prior art.

More particularly, it is an object of the present invention to provide a container of the above-mentioned general type which is easier to manufacture, more reliably retains the materials in separated condition, and provides for simpler and more reliable mixing and discharging of the materials, than the known containers.

In keeping with these objects and with others which will become apparent hereinafter, one feature of the present invention resides, briefly stated, in a container which has a first wall bounding a wider chamber, a second wall bounding a second chamber, a connecting sleeve member having one portion extending in a first direction and sealingly fitting on the first wall and another portion extending in an opposite direction and having an outer thread, a discharge cap fixedly connected to the second wall and having an inner thread which meshes with the outer thread of the other portion of the connecting sleeve member so that the discharge cap can be movably screwed on the latter, a separating member having a separating portion which separates the chambers from one another and a projecting portion which extends into the narrower chamber and is held by the second wall so that when the latter is withdrawn by unscrewing of the discharge cap, the separating member is loosened and the chambers communicate with one another, and means for retaining the discharge cap on the other portion of the connecting sleeve member during unscrewing and including an outer projection formed in the second wall in the region adjacent to said wider chamber, and an inner annular groove formed in the other portion of the connecting sleeve member in the same region, in which groove the outer projection engages, wherein the groove has a length which is equal to the length of the projecting portion of the separating member.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
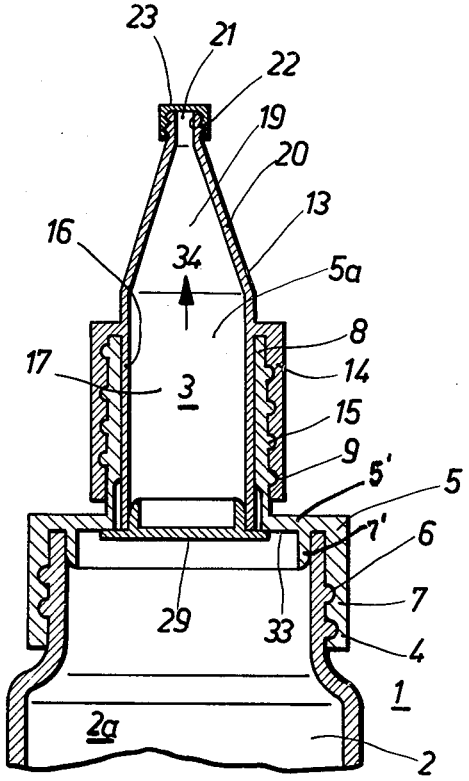
FIG. 1 is an axial section of a container in accordance with the present invention, in a position wherein its chambers are separated from one another.

A container in accordance with the present invention, as depicted in FIG. 1, is identified by reference numeral 1 and has a partially shown wider chamber 2 with an opening 2*a*, and a narrower chamber 3.

A wall which bounds the wider chamber 2 in the region of the opening 2*a* has an outer thread 4. A connecting sleeve-shaped member 5 is further provided, which has two portions 7 and 8 connected with one another and extending in two mutually opposite directions. The portion 7 has an inner thread 6 whereas the wall of the opening 2*a* of the wider chamber 2 has an outer thread 4 meshing with the inner thread 6. The portion 7 further has an inner projection 7′ extending inwardly of the wall of the opening 2*a*. When the portion 7 of the sleeve-shaped member 5 is screwed on the wall of the opening 2*a*, it seals the wider chamber 2 by means of edge pressure.

The portion 8 of the connecting sleeve member 5 bounds an opening 5*a* in the region spaced from the wider chamber 2. The portion 8 has an outer thread 9 and an inner annular groove 11, the latter being formed in the region adjacent to the wider chamber 2. The groove 11 extends in an axial direction and has a cylindrical section which is located near the wider chamber 2, and a further section which is spaced from the wider chamber 2 and is bounded by a steep flank 12, as more clearly shown in FIG. 2. The flank 12 has an angle of ascent relative to an outer surface of the groove 11 or, in other words, to an inner surface of the portion 8 of the connecting sleeve member 5, which is equal at least to 50°, preferably 60°.

A discharge cap 13 is fitted on the portion 8 of the connecting sleeve member 5. The discharge cap 13 has an outer cylindrical portion 14 which is provided with an inner thread 15 and screwed on the outer thread 9 of the portion 8 of the connecting sleeve member 5. The discharge cap 13 further has an inner cylindrical portion which forms a wall 16 of the narrower chamber 3. The inner cylindrical portion or wall 16 is connected with the outer cylindrical portion 14 in the region which is spaced from the wider chamber 2, and these portions are preferably of one piece with one another.

The inner cylindrical portion or wall 16 of the discharge cap 13 merges into a funnel-shaped extension 20 so that a cylindrical hollow 17 bounded by the former communicates with a funnel-shaped hollow 19 bounded by the latter. The narrower chamber 3 is thereby formed by both hollows 17 and 19. The funnel-shaped extension 20 terminates in a tip 22 provided with a discharge opening 21. The tip 22 has an outer thread onto which an inwardly threaded closure cap 23 is screwed.

Figure 2:
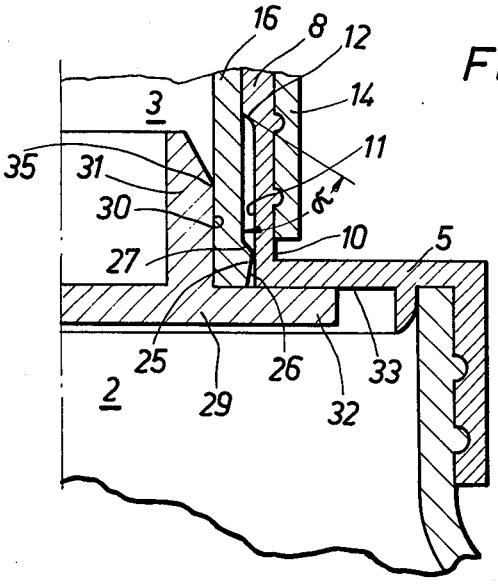
FIG. 2 is a fragment of the container shown in FIG. 1, in enlarged scale.

The cylindrical wall 16 of the narrower chamber 3 has an outer annular bead or projection 25 which is provided on an outer surface of the wall 16 in the region adjacent to the wider chamber 2, as more clearly shown in FIG. 2. The outer diameter of the projection 25 in non-assembled condition is at least by 1%, preferably by 2%, greater than the inner diameter of the groove 11 of the portion 8 of the connecting sleeve member 5. As a result of this relationship of the diameters, a sealing and at the same time sliding connection is formed between the projection 25 and the groove 11 in assembled condition. The projection 25 has a flank 26 which faces toward the wider chamber 2 and has an angle of ascent equal to substantially 30°, and a flank 27 facing away from the wider chamber 2 and having an angle of ascent which is equal to at least 50°, preferably to substantially 60°. The flank 27 of the projection 25 has a shape corresponding to the shape of the flank 12 of the groove 11.

A separating member 29 is further provided, having a separating portion 32 and a projecting portion 3. The projecting portion 31 is annular and extends into the hollow 17. A substantially cylindrical outer surface 30 of the projecting portion 31 abuts against an inner surface of the cylindrical wall 16 with pressure fit. The separating portion 32 is circular and extend in radial direction from the projecting portion 31. The separating portion 32 abuts from below against lower surface 33 of an intermediate portion 51 which connects with one another the portions 7 and 8 of the connecting sleeve member 5.

The wider chamber 2 serves for accommodating one component of a final product, for instance a liquid, whereas the narrower chamber 3 formed by the hollows 17 and 19 serves for accommodating another component of the final product, for instance a powder. In filled condition the chambers 2 and 3 are sealingly separated from one another. Means for sealingly separating the chambers are formed by the outer surface 31 of the separating member 29 together with the inner surface of the cylindrical wall 16, and by the outer annular projection 25 of the cylindrical wall 16 together with an inner annular groove 11 of the connecting sleeve member 5.

In the filled condition the container is delivered to a consumer, who mixes the components by shaking of the container, if necessary, after small unscrewing of the discharge cap 13. The final product or material which is formed by mixing the components, for instance, as a result of a chemical reaction of the same, can thereafter be discharged from the discharge cap 13.

The above-described mixing process includes the following steps. The discharge cap 13 is first unscrewed from a part of the outer thread 9 of the connecting sleeve member 5 in the direction which is identified by the arrow 34. The separating member 29, however, abuts by its separating portion 32 against the lower surface 33 and is retained in this position until a lower edge of the cylindrical wall 16 of the discharge cap 13 passes an upper edge 35 of the cylindrical outer wall 30 of the projecting portion 31 of the connecting sleeve member 5. Then, under the action of gravity the separating member 29 falls and the components accommodated in the narrower chamber 3 travels into the wider chamber 2 in the direction of the arrow 34*a*, as more clearly shown in FIG. 3. In the wider chamber 2 the components may be mixed with one another by shaking of the container, the process being further improved by the separating member 29 which freely moves in the wider chamber 2. The thus-produced final product can be discharged from the container after removal of the closure cap 23.

Figure 3:
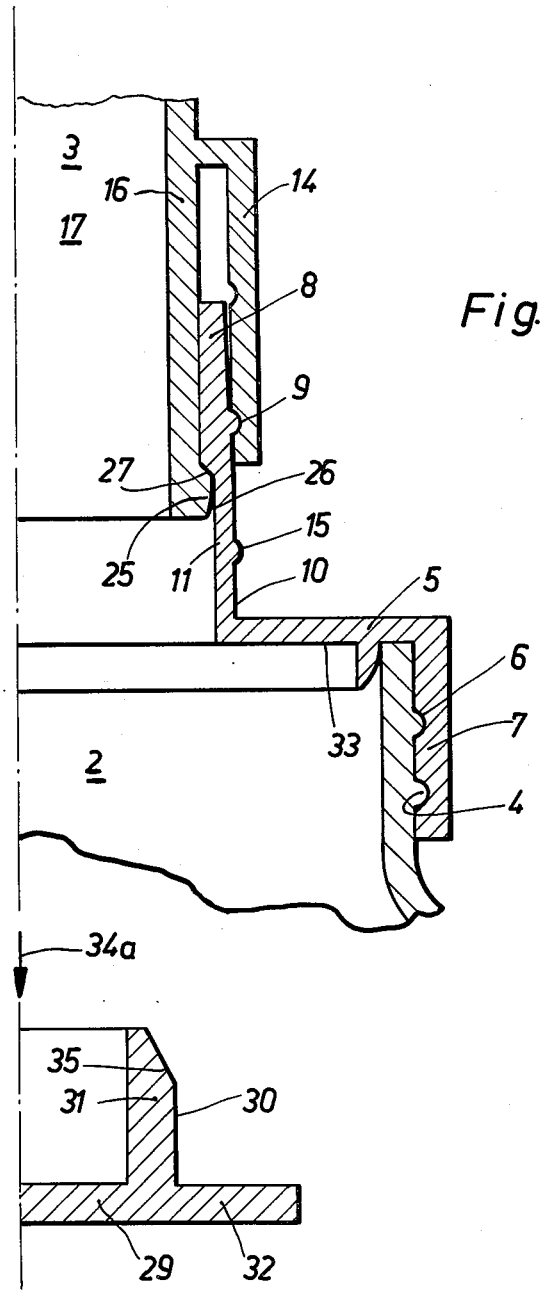
FIG. 3 is a view corresponding to that of FIG. 2 but showing the container in a position wherein its chambers communicate with one another.

FIG. 3 shows that in an open position of the discharge cap 13 the latter is retained on the connecting sleeve member 5 since the steep flank 27 of the annular projection 25 abuts against the steep flank 12 of the inner annular groove 11. This prevents unintentional complete removal of the discharge cap 13 from the connecting sleeve member 5.

It should be noted that the outer thread 9 of the portion 8 of the connecting sleeve member 5 has an axial length which is at least 1.5 times, preferably two times, greater than the axial length of the inner annular groove 11. The threads 4 and 6 together form a first threaded joint, and the threads 9 and 15 together form a second threaded joint, the joints having opposite direction of screwing and unscrewing. In other words, if the threads 4 and 6 are right-hand threads, the threads 9 and 15 will be left-hand threads. The inner thread 6 of the portion 7 and the outer thread 9 of the portion 8 of the connecting sleeve member 5 are coaxial with one another.

Figure 4:
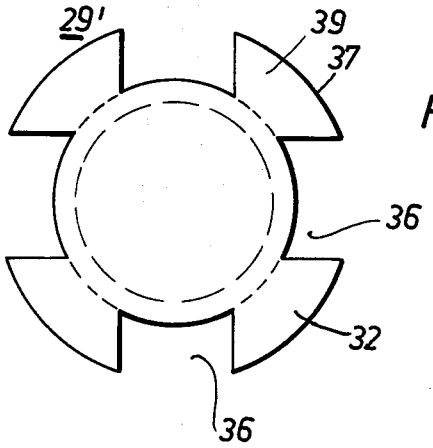
FIG. 4 is a plane view of a separating element of the container, in accordance with a further embodiment of the invention.
Figure 5:
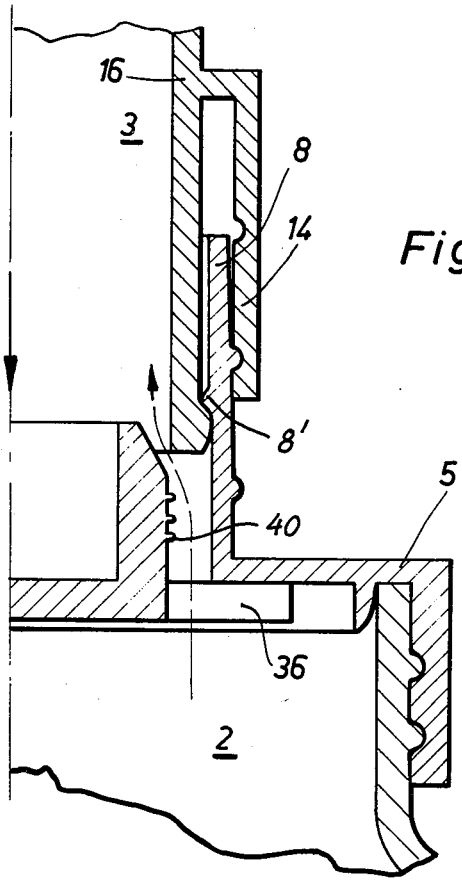
FIG. 5 is an axial section of the container provided with the separating element in accordance with the embodiment shown in FIG. 4.

FIGS. 4 and 5 depict a further improved embodiment of the invention, wherein the separating portion 32 of a separating member 29' is provided with four slots 36 which extend radially outwardly and are uniformly distributed in a circumferential direction of the portion 32. The slots 36 may extend at least up to the edge of the inner annular groove 11. As shown in the drawing, the slots 36 extend to an outer circumferential surface of the separating portion 32 and are open at this surface. Radially extending segments 39 are thereby formed between the slots 36. Such a construction has the advantage that even when the separating member is retained on the lower surface 33 for instance by glueing and does not fall, unobjectionable discharge of the component from the chamber 3 into the chamber 2 is also possible inasmuch as this component passes through the slots 36. The thus-produced final product can thereafter be discharged through the discharge opening 21 inasmuch as it can pass in the opposite direction from the wider chamber 2 into the narrower chamber 3 through the same slots 36.

In accordance with the in FIG. 5 shown embodiment of the present invention, the portion 8 of the connecting sleeve member 5 is provided with a radially inwardly extending annular rib 8' in the region which is spaced from the wider chamber 2. The inner diameter of the annular rib is smaller than the outer diameter of the cylindrical wall 16 by at least 1%. The flank 12 of the inner annular groove 11 is formed in the rib 8'. Thereby, sealing and sliding connection of the cylindrical wall 16 and the portion 8 is attained, in which case the sealing engagement of the projection 25 in the groove 11 can be dropped.

The connecting sleeve member 5, the discharge cap 13 and the closure cap 23 may be constituted by a synthetic plastic material. The projecting portion 31 of the separating member 29 may have at least one, preferably three annular bulges 40 as shown in FIG. 5, provided on the outer surface of this portion.

It will be understood, that each of the elements described above, or two or more together, may also find a useful application in other types of constructions differing from the types described above.

While the invention has been illustrated and described as embodied in a container for accommodating two materials separately from one another and mixing them, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A container for accommodating two materials separately from one another and mixing the same, comprising a first wall bounding a wider chamber for accommodating one material;

a second wall bounding a narrower chamber for accommodating another material;

a connecting sleeve member having one portion which extends in a first direction and is sealingly fitted on said first wall bounding said wider chamber, and another portion which extends in a second direction opposite to said first direction and has an outer thread;

a discharge cap fixedly connected with said second wall and having an inner thread which meshes with said outer thread of the other portion of said connecting sleeve member, said discharge cap being screwed on said other portion and movable relative to the latter;

a separating member having a separating portion arranged to disconnect said chambers from one another, and a projecting portion extending into said narrower chamber and being held by said second wall of the latter so that, when said second wall is withdrawn from said projecting portion of said separating member by unscrewing said discharge cap, said separating member is loosened and said chambers communicate with one another, said projecting portion of said separating member having a predetermined length; and means for retaining said discharge cap on said other portion of said connecting sleeve member during unscrewing of the former, said retaining means including an outer projection which is formed on said second wall in the region adjacent to said wider chamber, and an inner annular groove which is formed in said other portion of said connecting sleeve member also in the region adjacent to said wider diameter and in which said outer projection of said second wall movably engages, said annular groove extending in a direction away from said wider chamber and having a length which is substantially equal to the length of said projecting portion of said separating member.

2. A container as defined in claim 1, wherein said second wall bounding said narrower chamber has an axis and an outer surface, said outer projection of said retaining means being formed on said outer surface and extending in a radial direction.

3. A container as defined in claim 1, wherein said other portion of said connecting sleeve member has an inner surface facing toward said outer surface of said second wall, said inner groove being formed in said inner surface of said other portion.

4. A container as defined in claim 1, wherein said outer projection is annular.

5. A container as defined in claim 1, wherein said wider chamber has an opening located adjacent to said narrower chamber, said one portion of said connecting sleeve member being fitted on said first wall in the region of said opening.

6. A container as defined in claim 5, wherein said other portion of said connecting sleeve member has an opening which is narrower than said opening of said one portion, said second wall bounding said narrower chamber being received in said narrower opening of said other portion of said connecting sleeve member.

7. A container as defined in claim 6, wherein said connecting sleeve member has an axis, said other portion of said connecting sleeve member having a section which is spaced from said wider chamber and has radially inwardly extending annular ribs, said ribs having an inner diameter which is at most equal to the outer diameter of said second wall bounding said narrower chamber.

8. A container as defined in claim 7, wherein the inner diameter of said rib is smaller than the outer diameter of said second wall by at least 1%.

9. A container as defined in claim 1, wherein said discharge cap is of one piece with said second wall bounding said narrower chamber.

10. A container as defined in claim 1, wherein said outer projection of said second wall has two inclined flanks one of which faces toward said wider chamber and the other flank faces away from the latter, said other flank ascending steeper from said second wall than said one flank.

11. A container as defined in claim 10, wherein said inner annular groove of said other portion of said connecting sleeve member has a first section which is located adjacent to said wider chamber and is cylindrical, and a second section which is spaced from said wider chamber and is bounded by a steeply ascending flank which has a shape corresponding to the shape of said outer annular projection of said second wall.

12. A container as defined in claim 10, wherein said steeply ascending flank which bounds said second section of said inner annular groove has a shape corresponding to the shape of said other flank of said outer annular projection.

13. A container as defined in claim 10, wherein said other portion of said connecting sleeve member has an inner surface, said steeply ascending flank which bounds said second section of said annular groove is inclined to said inner surface of said other portion by an angle of ascent which is equal to at least 50°.

14. A container as defined in claim 13, wherein said angle of ascent is equal to 60°.

15. A container as defined in claim 1, wherein said discharge cap has one section which is located adjacent to said narrower chamber and is provided with said inner thread, and another section which is spaced from said narrower chamber, the other section of said discharge cap being funnel-shaped and having a discharge opening; and further comprising a closure member for closing said discharge opening.

16. A container as defined in claim 15, wherein said connecting sleeve member, said discharge cap and said closure member are constituted by a synthetic plastic material.

17. A container as defined in claim 15, wherein said other section of said discharge cap has an outer thread, said closure member having an inner thread and being screwed on said other section of said discharge cap.

18. A container as defined in claim 1, wherein said connecting sleeve member has an axis, said outer thread of said other portion of said connecting sleeve member having an axial length which is at least 1.5 times greater than that of said inner annular groove of said other portion of said connecting sleeve member.

19. A container as defined in claim 18, wherein the axial length of said outer thread of said other portion of said connecting sleeve member is 2 times greater than that of said inner annular groove.

20. A container as defined in claim 1; and further comprising means for sealingly fitting said one portion of said connecting sleeve member onto said second wall bounding said wider chamber, said sealingly fitting means including a threaded joint having a direction of screwing which is opposite to that of a threaded joint formed by said inner thread of said discharge cap and said outer thread of said other portion of said connecting sleeve member.

21. A container as defined in claim 20, wherein said threaded joint of said sealingly fitting means includes a further inner thread formed in said one portion of said connecting sleeve member and a further outer thread formed on said first wall of said wider chamber and meshing with said further inner thread.

22. A container as defined in claim 21, wherein said separating member has an axis, said further inner thread of said one portion of said connecting sleeve member and said outer thread of said other portion of the latter being coaxial with said separating member.

23. A container as defined in claim 1, wherein said separating member has an axis, said separating portion of said separating member extending in a radial direction and having a plurality of slots which extends in the radial direction and are spaced from one another in a circumferential direction.

24. A container as defined in claim 23, wherein said inner annular groove of said other portion of said connecting sleeve member has an edge, said slots of said separating portion of said separating member extending in said radial direction at least up to said edge.

25. A container as defined in claim 1, wherein said inner annular groove of said other portion of said connecting sleeve member has a predetermined inner diameter, said outer annular projection of said second wall bounding said narrower chamber has an outer diameter which is greater than the inner diameter of said inner annular groove by at least 1%.

26. A container as defined in claim 25, wherein the outer diameter of said outer annular projection is greater than the inner diameter of said inner annular groove by substantially 2%.

27. A container as defined in claim 1, wherein said projecting portion of said separating member has an outer surface and at least one annular bulge on said outer surface.

28. A container as defined in claim 27, wherein said projecting portion has three such annular bulges.

29. A container as defined in claim 1, wherein said outer projection of said second wall has one flank which faces toward said wider chamber and another flank which faces away from the latter and is steeper than said one flank, said inner annular groove of said other portion of said connecting sleeve member having a first section adjacent to said wider chamber and a second section which is spaced from said wider chamber and is bounded by a steeply ascending flank which has a shape corresponding to the shape of said other flank of said outer projection of said second wall, said steeply ascending flank which bounds said second section of said inner annular groove is formed in said annular rib.

* * * * *